United States Patent [19]

Usimaki

[11] Patent Number: 4,802,256

[45] Date of Patent: Feb. 7, 1989

[54] SLIDE HAMMER CHIMNEY CLEANER

[76] Inventor: Marvin W. Usimaki, Rte. 1, Box 186, Pelke, Mich. 49958

[21] Appl. No.: 94,140

[22] Filed: Sep. 8, 1987

[51] Int. Cl.[4] ..... F23J 3/00

[52] U.S. Cl. ..... 15/243; 15/104.07

[58] Field of Search ..... 15/104.07, 104.16, 162, 15/163, 242, 243, 249; 126/16

[56] References Cited

U.S. PATENT DOCUMENTS

| | | | |
|---|---|---|---|
| 1,758,950 | 5/1930 | Hunecke | 15/243 |
| 4,399,584 | 8/1983 | Batson | 15/243 |
| 4,408,368 | 10/1983 | Vickery | 15/243 |
| 4,583,258 | 4/1986 | Carroll | 15/249 |
| 4,688,291 | 8/1987 | Vriesen | 15/243 |

*Primary Examiner*—Edward L. Roberts

*Attorney, Agent, or Firm*—Reising, Ethington, Barnard, Perry & Milton

[57] ABSTRACT

A chimney cleaning apparatus (10) is suspended from a chain (34) for movement through a chimney flue (16) and includes a scraping plate (12). The outer periphery of the scraping plate (12) conforms to the cross-sectional shape of the chimney flue (16) and is rigid for unyielding by moving through the flue (16) in a perfectly transverse orientation to clean all debris therefrom. The scraping plate (12) is slidable along a weighted shaft (22) for enabling the apparatus (10) to be hammered through the chimney flue (16).

8 Claims, 2 Drawing Sheets

SLIDE HAMMER CHIMNEY CLEANER

TECHNICAL FIELD

This invention relates to a chimney cleaning apparatus suspended from a cable in a chimney flue and moved therethrough.

BACKGROUND ART

It is well known in the art of chimney cleaning to suspend a cleaning apparatus in a chimney flue and move the apparatus therethrough in attempts to remove the debris and soot buildup from the inner flue surface. One example of a typical chimney cleaning apparatus is shown in the U.S. Pat. No. 1,837,931 to Walborhl, issued Dec. 22, 1931. The Walborhl patent discloses a chimney apparatus assembly including an eye 7 connected to a weight 15 by a length of chain 17. Slideable along the chain 17, between the eye 7 and the weight 15, is disposed a tubular body 3 supporting a plurality of radially extending wire bristles By repeatedly raising and dropping the chimney cleaning apparatus, the bristles 1 are "hammered" through the chimney flue.

The prior art chimney cleaning apparatus are deficient in that they incorporate yieldable bristles to scrape against the chimney flue for removing the debris. When large debris or particularly "gummy" soot buildup is encountered, the prior art chimney cleaning apparatus bristles deflect around the obstruction and thus do not completely clean the inside of the chimney flue. This is particularly dangerous with the ever present threat of a chimney fire.

SUMMARY OF INVENTION AND ADVANTAGES

The subject invention provides an apparatus for cleaning debris from the inner surface of a chimney comprising a scrapping plate and a support means. The scraping plate has a periphery for conforming to the cross-sectional shape of the inside flue of the chimney. The support means supports the scraping plate in a transverse orientation, relative to the longitudinal axis of the chimney flue, while moving the scraping plate through the chimney flue. The chimney cleaning apparatus of this invention is characterized by providing a scraping plate which is inflexible, for unyieldingly scraping the inside surface of the chimney flue during movement therethrough.

The scraping plate of the subject invention is a rigid member which will not deflect around chimney flue debris or "gummy" soot buildup, thereby completely cleaning the inside surface of a chimney flue. Additionally, the subject invention is easily and inexpensively manufactured from readily available materials, and can be operated by a single person.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

An apparatus for cleaning debris from the inner surface of a chimney is generally shown at 10 in FIGS. 1 through 4. The subject apparatus 10 comprises a scraping plate, generally indicated at 12, and a support means, generally indicated at 14.

Figure 1:
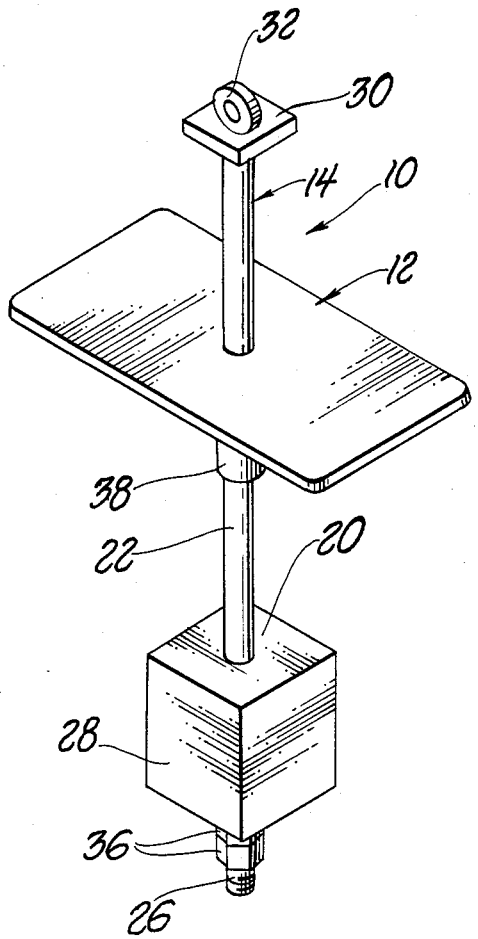
FIG. 1 is a perspective view of the preferred embodiment of the subject invention.

The scraping plate 12 has a periphery for conforming to the cross-sectional shape of the inside flue 16 of a chimney. As shown in FIG. 1, the peripheral shape of the scraping plate 12 is rectangular, as is the cross-sectional shape of the majority of chimney flues 16: however, the geometric configuration will conform to the cross-section of the chimney flue, which may be polygonal, circular, etc. The support means 14 supports the scraping plate 12 in a transverse orientation relative to the longitudinal axis of the chimney flue 16, while moving the scraping plate through the chimney flue 16. In other words, the support means 14 supports the scraping plate 12 in a perfectly transverse, or horizontal, orientation in the chimney flue 16. If the scraping plate 12 does not remain in a perfectly transverse orientation in the chimney flue 16, the peripheral edges of the scraping plate 12 will not contact the entire inner surface of the flue 16, thereby ineffectively cleaning the built-up debris.

The subject apparatus 10 is characterized by the scraping plate 12 being inflexible for unyielding scraping the inside surface of the chimney flue 16 during movement therethrough. That is to say, the scraping plate 12 is a rigid member which will not deflect as it scrapes the inside surface of the chimney flue 16. By providing a rigid scraping plate 12, and by supporting the scraping plate 12 in a perfectly transverse orientation in the chimney flue 16, the debris and soot buildup in the chimney flue 16 is completely dislodged.

Figure 2:
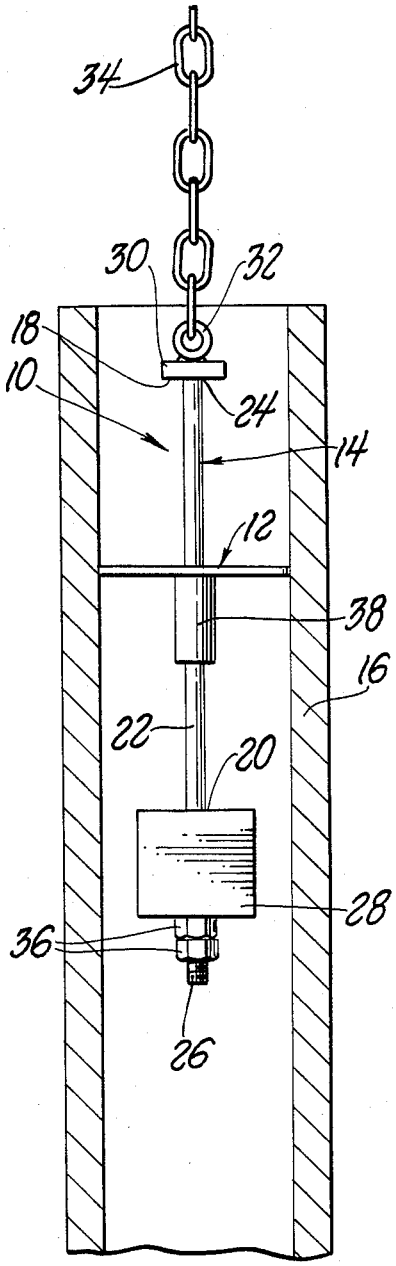
FIG. 2 is a side view of the subject invention disposed in a chimney flue during one phase of operation.
Figure 3:
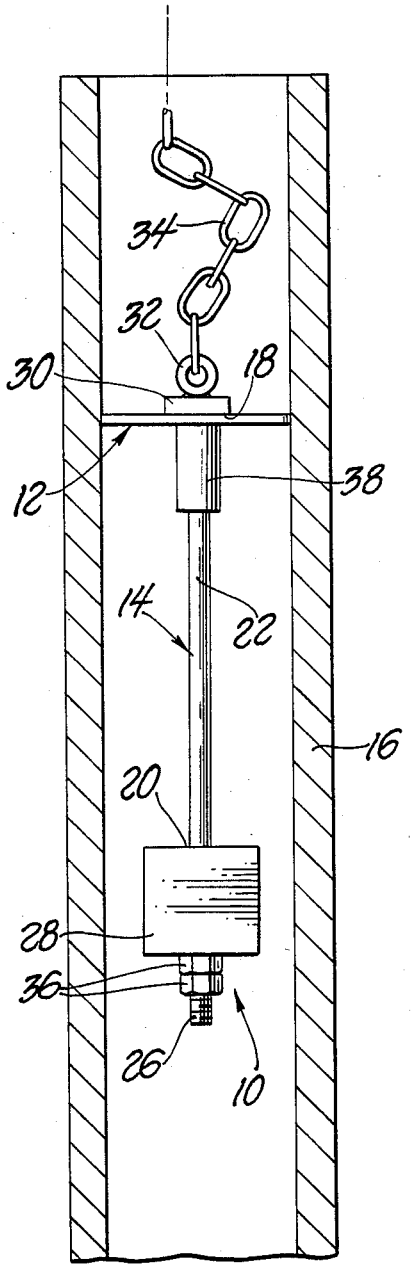
FIG. 3 is a side view of the subject invention disposed in a chimney flue in another phase of operation.
Figure 4:
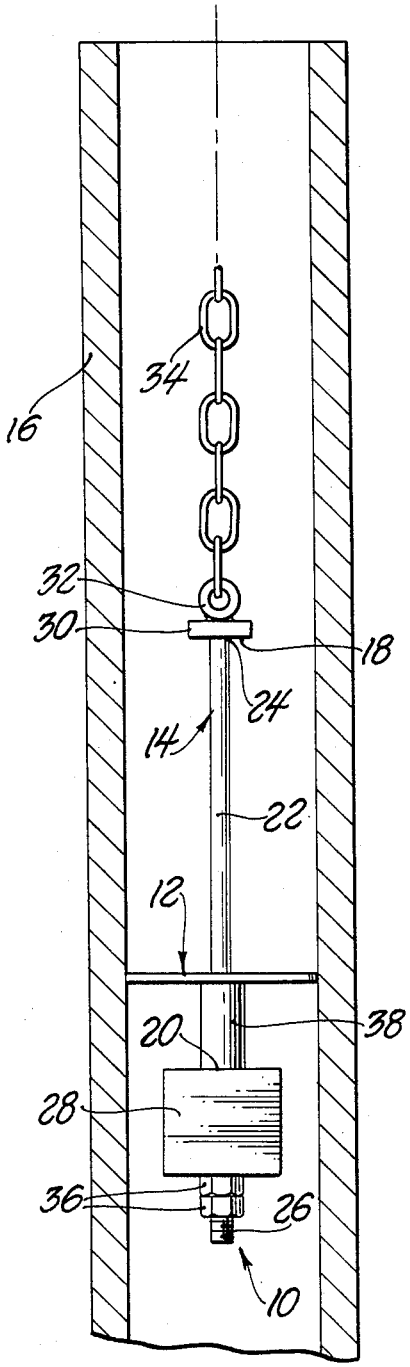
FIG. 4 is a side view of the subject invention disposed in a chimney flue in yet another phase of operation.

As shown in FIGS. 2 through 4, the scraping plate 12 is slideable along the support means 14 between a first striking surface 18 and a longitudinally spaced second striking surface 20. As will be described in greater detail subsequently, the scraping plate 12 is slideable between the first striking surface 18 and the second striking surface 20 for allowing the scraping plate 12 to be forced to move through the chimney flue 16 by impact against either the first 18 or the second 20 striking surface.

The support means 14 includes an elongated shaft 22 disposed perpendicularly and centrally through the scraping plate 12. It is found that adequate results are provided when the shaft 22 length equals approximately 30 inches. Additionally, $\frac{3}{4}$ inch round stock steel rods have been found to supply sufficient rigidity for use as a shaft 22. As the scraping plate 12 is slideable along the support means 14, the shaft 22 provides a guide for restricted movement of the first 18 and second 20 striking surfaces against the scraping plate 12. The support means 14 has a top end 24 disposed adjacent the first striking surface 18. A bottom end 26 of the support means 14 is disposed adjacent the second striking surface 20. As will be readily seen from the Figures, the top end 24 is located at the uppermost end of the shaft 22, and the bottom end 26 is located at the lowermost end of the shaft 22.

A weight member 28 is disposed on the shaft 22 adjacent the bottom end 26. The weight member 28 is slideable along the shaft 22 between the scraping plate 12 and the bottom end 26. In this manner, the second striking surface 20 is defined by the surface of the weight member 28 adjacent scraping plate 12. Satisfactory chimney cleaning results have been achieved by using a weight member 28 having an approximate weight force of ten pounds.

The top end 24 of the support means 14 comprises a perpendicular hammer plate 30 fixedly mounted thereon. As shown in the Figures, the hammer plate 30 may take the form of a small rectangular member. The first striking surface 18 is defined by the surface of the hammer plate 30 adjacent the scraping plate 12. In other words, the surface of the hammer plate 30 facing the scraping plate 12 is used as the first striking surface 18 during the chimney cleaning operation. A hooking means 32 is disposed on the top end 24 of the support means 14 for providing attachment for a chain 34 or cable to move the apparatus 10 through the chimney flue 16. As shown in the Figures, the hooking means 32 can be a ring or eye fixedly attached to the upper surface of the hammer plate 30.

The scraping plate 12 is removeable from the support means 14 for allowing one scraping plate 12 to be exchanged for another of different size. The ability to readily exchange one size scraping plate 12 for another is particularly useful since the size of chimney flues are not necessarily the same from house to house. The scraping plate 12 is made removeable from the support means 14 by providing, at the bottom end 26, fasteners 36 which are removably threaded on the shaft 22. Two fasteners 36 are "locked" on the threaded bottom end 26 by tightening into each other. The weight member 28 is made moveable, or slideable, on the shaft 22 so that by unthreading the fasteners 36, the weight member 28 is slid off the bottom end 26 of the shaft 22, thereby allowing the scraping plate 12 to be removed via the bottom end 26. A new scraping plate 12 of different size or peripheral geometric shape can then be positioned on the shaft 22, followed by the replacing of the weight member 28 and the fasteners 36. The above described method of removing the scraping plate 12 is particularly easy, and can be quickly performed with a minimum of tools.

The scraping plate 12 includes a sleeve member 38 fixedly attached thereto for supporting the scraping plate 12 on the shaft 22 in a perpendicular orientation relative to the longitudinal axis of the shaft 22. The sleeve 38 is mounted on the scraping plate 12 adjacent the weight member 28, as shown in the Figures. Because the scraping plate 12 can be of a relatively small thickness, the sleeve 38 performs the important function of maintaining the scraping plate 12 perpendicular relative to the longitudinal axis of the shaft 22. As described above, the subject apparatus 10 is particularly effective in cleaning the chimney flue 16 as long as the scraping plate 12 is maintained transverse, or perpendicular, to the longitudinal axis of the chimney flue 16, while moving therethrough. The weight member 28 is disposed below the scraping plate 12 to assist in maintaining the scraping plate 12 in a transverse orientation in the chimney flue 16. If the weight member 28 were disposed above the scraping plate 12, the apparatus 10 would have a tendency to shift out of the transverse orientation in the chimney flue 16.

In operation, the subject apparatus 10 is positioned in the top of the chimney flue 16. The support means 14 is raised by the chain 34, while the scraping plate 12 remains frictionally wedged in the chimney flue 16, as shown in FIG. 2. The tension on chain 34 is released, allowing the combined weight force of the support means 14 to create sufficient momentum as the shaft 22 slides through the scraping plate 12. The first striking surface 18 contacts the scraping plate 12 to "hammer" the scraping plate 12 through the chimney flue 16, as shown in FIG. 3. In other words, the chain 34 is repetitiously raised and dropped to force the scraping plate 12 through the chimney flue 16. The hammering procedure is repeated until the apparatus 10 has been moved completely through the chimney. The apparatus 10 is then retrieved by pulling upward on the chain 34. If a minor obstruction or resistance is encountered during the assent, the apparatus 10 is hammered upward, by pulling the second surface 20 repeatedly against the sleeve member 38, as shown in FIG. 4. The upward hammering of the apparatus 10 is relatively easy, as the chimney flue is now clean.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An apparatus (10) for cleaning debris from the inner surfaces of a chimney comprising; a scraping plate (12) having a periphery for completely conforming to the cross-sectional shape of the inside flue (16) of a chimney, and a support means (14) for supporting said scraping plate (12) in a transverse orientation relative to the longitudinal axis of the chimney flue (16) while moving said scraping plate (12) through the chimney flue (16), said apparatus (10) characterized by said scraping plate (12) being inflexible and said periphery thereof contacting the entire inside surface of the chimney flue (16) for unyielding scraping the entire inside surface of the chimney flue (16) during movement therethrough and being slidable along said support means (14) between a first striking surface (18) and a longitudinally spaced second striking surface (20), said support means (14) including an elongated shaft (22) disposed perpendicularly and centrally through said scraping plate (12), and said scraping plate (12) including a sleeve member (38) fixedly attached thereto for supporting said scraping plate (12) on said shaft (22) in a perpendicular orientation relative to the longitudinal axis of said shaft (22).

2. An apparatus (10) as set forth in claim 1 further characterized by said scraping plate (12) being removeable from said support means (14) for allowing one said scraping plate (12) to be exchanged for another of different size.

3. An apparatus (10) as set forth in claim 2 further characterized by said support means (14) including a top end (24) disposed adjacent said first striking surface (18), a bottom end (26) disposed adjacent said second striking surface (20), and a weight member (28) disposed on said shaft (22) adjacent said bottom end (26).

4. An apparatus (10) as set forth in claim 3 further characterized by said weight member (28) being slideable along said shaft (22) between said scraping plate (12) and said bottom end (26), whereby said second striking surface (20) is defined by the surface of said weight member (28) adjacent said scraping plate (12).

5. An apparatus (10) as set forth in claim 4 further characterized by said bottom end (26) of said support means (14) comprising fasteners (36) removeably threaded on said shaft (22).

6. An apparatus (10) as set forth in claim 5 further characterized by said top end (24) of said support means (14) comprising a perpendicular hammer plate (30) fixedly mounted thereon, whereby said first striking surface (18) is defined by the surface of said hammer plate (30) adjacent said scraping plate (12).

7. An apparatus (10) as set forth in claim 6 further characterized by said sleeve member (38) mounted on said scraping plate (12) adjacent said weight member (28).

8. An apparatus (10) as set forth in claim 1 further characterized by including a hooking means (32) disposed on said top end (24) of said support means (14) for providing attachment for a chain (34) or cable to move said apparatus (10) through the chimney flue (16).

* * * * *